United States Patent [19]

Uenaka et al.

[11] 4,367,941

[45] Jan. 11, 1983

[54] APPARATUS FOR SILVER RECOVERY DURING PHOTOGRAPHIC PROCESSING

[75] Inventors: Kazushige Uenaka; Shinichi Kashiwagi; Toshiro Tahara; Kazuo Shirasu, all of Minami-ashigara; Yoshio Usui, Tokyo; Akira Abe, Tokyo; Fumio Nakagawa, Tokyo; Tetsuya Masuda, Tokyo, all of Japan

[73] Assignee: Fuji Photo Film Co., Ltd., Kanagawa, Japan

[21] Appl. No.: 290,042

[22] Filed: Aug. 5, 1981

Related U.S. Application Data

[62] Division of Ser. No. 148,608, May 12, 1980, Pat. No. 4,343,892.

[30] Foreign Application Priority Data

May 11, 1979 [JP] Japan ..... 54-58300

[51] Int. Cl.[3] ..... G03D 3/02

[52] U.S. Cl. ..... 354/324; 75/118 P

[58] Field of Search ..... 354/297, 324; 75/118 P; 204/109; 430/463

[56] References Cited

U.S. PATENT DOCUMENTS

| | | | |
|---|---|---|---|
| 1,907,252 | 5/1933 | Debrie | 430/473 |
| 4,081,816 | 3/1978 | Geyken et al. | 354/297 |
| 4,265,431 | 5/1981 | Falmo | 75/118 P |

FOREIGN PATENT DOCUMENTS

| | | | |
|---|---|---|---|
| 1353805 | 5/1974 | United Kingdom | 75/118 P |

OTHER PUBLICATIONS

Goldwasser, Journal of SMPTE, vol. 64, pp. 248–253, May 1955.

*Primary Examiner*—L. T. Hix
*Assistant Examiner*—Alan Mathews
*Attorney, Agent, or Firm*—Sughrue, Mion, Zinn, Macpeak & Seas

[57] ABSTRACT

The efficiency of silver recovery from photographic processing solutions is improved by the installation of a silver recovery water tank between the fix or blix tank and the wash water tank, which is provided with a mechanism for maintaining the silver concentration of said recovery tank at a substantially constant value, said mechanism comprising a detecting means for measuring the amount of the photographic material treated by the processing line involved and a means to supply water thereto operatable by signal from said detecting means.

4 Claims, 2 Drawing Figures

APPARATUS FOR SILVER RECOVERY DURING PHOTOGRAPHIC PROCESSING

This is a division of application Ser. No. 148,608, filed May 12, 1980, now U.S. Pat. No. 4,343,892.

BACKGROUND OF THE INVENTION

1. Field of the Invention

This invention relates to a method and apparatus for silver recovery during photographic processing.

2. Description of the Prior Art

In the processing of photographic films and papers, fixing or blix solutions are commonly used, the main ingredient of which is a thiosulfate salt.

The fixing solution functions to remove the silver salt remaining in the photographic material after exposure without its reduction to metallic silver by the action of the developer fluid. The silver salt not reduced is dissolved into the fixing fluid in the form of a silver thiosulfate complex anion. On the other hand, the blix fluid is used for rapid processing of certain types of photographic color materials whereby a ferric salt of ethylenediaminetetraacetic acid is included therein in addition to the thiosulfate salt to reoxidize the silver formed by the reduction by the developer, and the oxidized silver salt is removed together with the original silver salt not reduced during the preceding development, both being dissolved and removed from the photographic material in the form of silver thiosulfate complex anion.

Accordingly, the fixing or blix fluid employed for photographic processing contains accumulated silver salt from the photographic material in the form of silver thiosulfate complex anion. Usually the silver content amounts to from 1 g/l to 10 g/l and, in some instances, up to about 20 g/l.

In most cases, the photographic material is washed with water subsequent to fix or bleach-fix. Such washing operation completely removes the residual fix or blix fluid from the photographic material, and thus prevents the silver or dye image resulting in the photographic material form discoloration during prolonged storage. Thus, the fix or blix fluid containing silver complex salts that is carried over by the photographic material into the water wash tank is finally discarded, in a diluted condition, with the wash water waste. Since the water wash is maintained so as not to raise the chemical content thereof by means of continuous supply of a large amount of fresh water, the concentration of silver in the wash water does not usually exceed the level of 1 mg/l to 20 mg/l. However, the total amount of the silver discarded together with the wash water is not negligibly small, in view of the large volume of wash water employed. To recover this amount of silver from the wash water is self-evidently of high economic significance.

Conventionally, however, no practical method of recovering such silver from wash water has been established, thus permitting uneconomical loss of silver.

Recently, the method for recovering the silver from the large amount of waste water containing a very small amount of the silver (for example, a wash water waste) using an anion exchange resin has been proposed. However, it was reported that the capacity of said anion exchange resin was deteriorated with deposition of such an organic compound as gelatin or etc., which was eluted from photographic materials for a short period (Daniel G. Marsh, "Removal of Residual Silver form Processing Waste Water by Ion Exchange", *Journal of Applied Photographic Engineering,* Vol. 4, No. 1, pp. 17–22 (1978)). Also, form the experimentation performed by the inventors of the present invention, the method described above cannot be practiced economically, since when it recovered by ion exchange resin, the silver thiosulfate complex anion was gradually changed to silver sulfide which did not elute form the ion exchange resin, and reclaiming is impossible.

Further, the method for recovering the silver using a reverse osmosis film was considered, but this method cannot be practiced since the apparatus is expensive.

SUMMARY OF THE INVENTION

An object of the present invention is to solve the above-mentioned problem, and more in detail to provide a method of silver recovery during photographic processing, and an apparatus for conducting the method in which the use of a silver recovery water tank placed between a tank for a processing fluid containing silver and a wash water tank; after having passed through said processing fluid the photographic material is immersed in said silver recovery water tank for a short period, then immersed in the wash water tank, in order to prevent that the silver complex salt is carried over the photographic material into the water wash tank and is discarded with the wash water waste.

This object of the invention is achieved by installing a silver recovery water tank between a tank for a silver-containing photographic processing fluid and a water wash tank, collecting the silver-containing processing fluid carried by the photographic material coming form said processing tank in said silver recovery water tank, and keeping the silver concentration in said silver recovery water tank substantially constant by supplying an amount of water corresponding to the amount of treated photographic materials.

DETAILED DESCRIPTION OF THE INVENTION

In the following description, the present invention will be explained in more detail by reference to the drawings.

Figure 1:
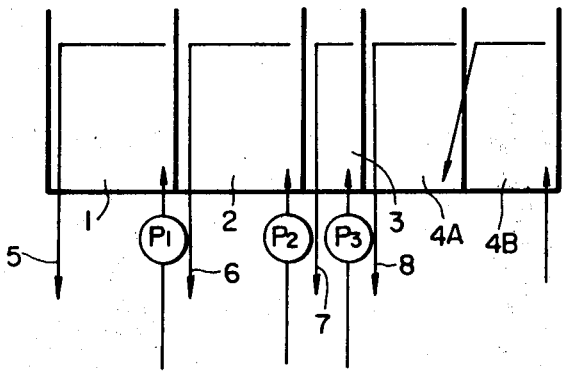
FIGS. 1 and 2 each represents a schematic cross-sectional side view of an embodiment of the invention, in which 1 denotes a developing tank, 2 a fixing tank, 3 a silver recovery water tank, and $P_1$, $P_2$ and $P_3$ each denotes a constant-flow-rate pump.

FIG. 1 schematically illustrates a cross-sectional side view of a photographic processing apparatus embodying the present invention, which comprises developing tank 1, fixing tank 2, silver recovery water tank 3 and two water wash tanks 4A and 4B. Photographic materials to be processed are transported through each of the above cited processing or treating tanks from left to right by a transport means (not shown) for sequential processings or treatments. Replenishing fluid supply pump $P_1$, $P_2$ or $P_3$ are connected to developing tank 1, fixing tank 2 and silver recovery water tank 3, respectively. Each of these pumps is regulated independently so as to supply a controlled amount of fluid. Tap water is fed to water wash tank 4B.

In the present embodiment, the treated amount of photographic material (the number of sheets for a sheet form material, and the length of the web for a roll material) is measured, according to which a pre-determined amount of replenisher fluid for each tank is added to each of the tanks. Tap water is supplied as the replenisher fluid to the silver recovery water tank 3. Thus, the working strength of developer as well as fixer is kept constant, while, at the same time, the silver concentration in the silver recovery water tank is maintained within a preferred range. When the volume of the processing fluid or of the silver containing recovery water exceeds that of the tank, the excessive amount is discharged through overflow pipes 5, 6, 7 or 8 for reuse or further recovery treatments.

Figure 2:
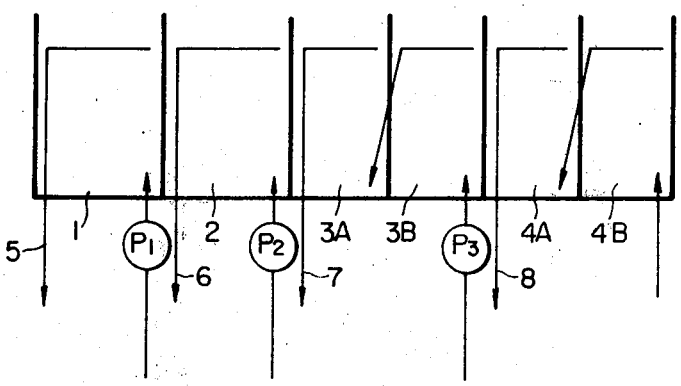

FIG. 2 illustrates another embodiment of the present invention wherein two silver recovery water tanks similar to the water wash tanks in FIG. 1 are provided. In this embodiment, the silver recovery means comprises two tanks 3A and 3B, and the so-called cascade water supply system is employed, with flow from the second tank 3B to the first (upstream-side) tank 3A, enabling a better silver recovery efficiency (i.e., the silver concentration in the water adhering to the photographic material leaving the silver recovery tank becomes even lower than in the previous embodiment). It should be noticed that the rate of silver reclaimed per unit volume of water fed to the silver recovery tank is improved using this two tank embodiment of the invention.

The rate of supplying tap water to the silver recovery water tank in the above-cited embodiment should preferably be from about 2 to 10 times as large as the carry-over amount of the fixer by the photographic material, and more preferably is from 2 to 6 times said amount.

Under these conditions, the silver concentration in the overflow from the silver recovery water tank can be equilibrated at a stable level within in two days after the start of processing. The preferable level of such an equilibrium concentration is from about 0.5 to 3 g Ag/l, though it depends on the total volume, and the difficulty and economy with which silver can be recovered from the overflow from the silver recovery water tank.

Although the above explanation has been given on the case of silver recovery by the use of specific water tank installed to precede treatment of the photographic material in the water wash tank, the concept of the invention can further be applied for similar purposes in which other ingredients are effectively reclaimed or in which certain pollutants are collected so as not to pollute environment. In such cases it is necessary to determine the supply rate of tap water to the recovery tank relative to the fluid to be treated, taking into consideration of the subsequent treatments depending on the ingredients of concern.

In order to raise the recovery efficiency, the upstream side of the recovery tank should desirably contain water in which the ingredient to be collected be concentrated as much as possible, while the water in the downstream side of the tank should be diluted as much as possible, so as not to permit the ingredient in concern to be carried into a subsequent treating tank. To realize these requirements, resort can be made to the use of multiple recovery tanks using water-supplied by a cascade method.

As will be clear from the descriptions heretofore, the instant invention enables highly efficient recovery of valuable ingredients or the gathering of pollutants generated in photographic processing.

The present invention will now be described in more detail by reference to examples which, however, do not limit the present invention in any way.

EXAMPLE 1

The color negative film was processed using the apparatus shown in FIG. 1 consecutively.

The rate of supplying tap water to a silver recovery water tank 3 was 4 times as large as the amount of the fixer carried-over by the photographic material form a fixing tank 2 to the silver recovery water tank 3.

Further, the capacity of the silver recovery water tank 3 was about 0.5 time as large as the total amount of the tap water replenished until no concentration increase of silver in the silver recovery water tank 3 could be obserbed. Then, the concentration of silver was gradually increased until the processing amount of the color negative film attained to about 350 $m^2$, but after that no concentration increase could be obtained.

EXAMPLE 2

The color negative film was processed using the apparatus shown in FIG. 2 consecutively.

The rate of supplying tap water to a silver recovery water tank 3B was 2.7 times as large as the amount of the fixer carried-over by the photographic material form a fixing tank 2 to a silver recovery water tank 3A and the same amount of fluid as the amount of the supplying tap water to a silver recovery water tank 3B describe above was supplied from the silver recovery water tank 3B to the silver recovery water tank 3A. Further, each capacity of the silver recovery water tank 3A and 3B is about one third time as large as the total amount of the tap water replenished until no concentration increase of silver in the silver recovery water tank 3A could be obserbed. Then, after the processing amount of the color negative film attained to about 6,000 $m^2$, no concentration increase of silver in the silver recovery water tank 3A could be observed.

While the invention has been described in detail and with reference to specific embodiments thereof, it will be apparent to one skilled in the art that various changes and modifications can be made therein without departing from the spirit and scope thereof.

What is claimed is:

1. An apparatus for recovering silver during photographic processing by collecting a silver-containing photographic processing fluid carried by photographic materials transported from a processing tank containing a silver-containing processing fluid, said apparatus comprising a silver recovery tank interposed between the processing tank containing said silver-containing processing fluid and a water wash tank, wherein said processing tank and said silver recovery tank are each provided with an independently regulated replenishing fluid supply pump and an overflow pipe, whereby said tanks may be provided with replenishing fluid and drained of excess fluid, wherein said replenishing fluid supplied to said silver recovery tank is determined by the amount of said photographic materials introduced to said processing tank.

2. An apparatus for recovering silver during photographic processing as in claim 1, wherein said apparatus comprises multiple silver recovery water tanks and the water supplied thereto is supplied at the downstream side of the tank, and is pumped out at the upstream side thereof to the adjacent upstream tank in turn.

3. The apparatus of claim 2, wherein said replenishing fluid is supplied in an amount about 2–10 times as great as the amount of photographic materials introduced to said processing tank.

4. The apparatus of claim 2, wherein said replenishing fluid is supplied in an amount of about 2–6 times the amount of photographic materials introduced to said processing tank.

* * * * *